US006578716B1

(12) United States Patent
Wei

(10) Patent No.: US 6,578,716 B1
(45) Date of Patent: Jun. 17, 2003

(54) COMBINATION HAT RACK STRUCTURE

(75) Inventor: Chang-Min Wei, Taichung (TW)

(73) Assignee: Wisdom Hat & Cap Co., Ltd., Taichung (TW)

( * ) Notice: Subject to any disclaimer, the term of this patent is extended or adjusted under 35 U.S.C. 154(b) by 0 days.

(21) Appl. No.: 10/056,493

(22) Filed: Jan. 28, 2002

(51) Int. Cl.[7] ..... A47F 7/06
(52) U.S. Cl. ..... 211/33; 223/12; 206/9
(58) Field of Search ..... 211/20, 32, 33; 206/8, 9, 278; 223/7, 12, 24, 66; D6/315, 320, 328

(56) References Cited

U.S. PATENT DOCUMENTS

| | | | | | |
|---|---|---|---|---|---|
| 621,023 | A | * | 3/1899 | Boas | 211/33 |
| 1,168,389 | A | * | 1/1916 | Zitka | 223/66 |
| 1,231,635 | A | * | 7/1917 | Nelson | 211/33 |
| 1,600,132 | A | * | 9/1926 | Pearl | 312/114 |
| 1,698,633 | A | * | 1/1929 | Jimenez | 223/24 |
| 1,746,487 | A | * | 2/1930 | Martin | 211/33 |
| 1,888,375 | A | * | 11/1932 | Diener | 223/26 |
| 1,969,716 | A | * | 8/1934 | Cohen | 211/33 |
| 1,993,399 | A | * | 3/1935 | Cohen | 211/33 |
| 2,034,924 | A | * | 3/1936 | Simon | 211/33 |
| 2,291,877 | A | * | 8/1942 | Carter et al. | 211/33 |
| 2,298,602 | A | * | 10/1942 | Varon | 223/24 |
| 2,803,350 | A | * | 8/1957 | Osgoodby | 211/33 |
| 3,198,408 | A | * | 8/1965 | Benner | 223/66 |
| 3,300,108 | A | * | 1/1967 | Schumer | 223/66 |
| 3,464,603 | A | * | 9/1969 | Hunter | 223/66 |
| 3,515,318 | A | * | 6/1970 | Preble | 223/66 |
| 3,606,108 | A | * | 9/1971 | Baugh et al. | 223/66 |
| 5,172,837 | A | * | 12/1992 | Finney, et al. | 223/23 |
| 5,868,368 | A | * | 2/1999 | MacDonald | 248/176.3 |
| 6,234,368 | B1 | * | 5/2001 | DesForges et al. | 223/66 |

* cited by examiner

*Primary Examiner*—Daniel P. Stodola
*Assistant Examiner*—Jennifer E. Novosad
(74) *Attorney, Agent, or Firm*—Charles E. Baxley

(57) ABSTRACT

A combination hat rack structure includes a domed housing, a support seat, and a frame. The combination hat rack structure may provide a plane display effect, may be suspended on the wall, and may be disposed in an inclined manner, thereby enhancing the versatility of the combination hat rack structure.

2 Claims, 4 Drawing Sheets

COMBINATION HAT RACK STRUCTURE

BACKGROUND OF THE INVENTION

1. Field of the Invention

The present invention relates to a combination hat rack structure, and more particularly to a combination hat rack structure which may provide a plane display effect, may be suspended on the wall, and may be disposed in an inclined manner, thereby enhancing the versatility of the combination hat rack structure.

2. Description of the Related Art

A hat may be placed in a place or site for exhibition, such as in a shopping mall, a department store or the like. Usually, the hat may be placed on an exhibition table, may be suspended on the wall, and may be suspended on a plastic model, thereby providing an exhibition effect. However, when the hat is placed on the exhibition table or suspended on the wall, the hat easily contracts inward due to its soft feature, thereby decreasing its aesthetic quality. On the other hand, when the hat is suspended on the plastic model, the plastic model occupies a large space, thereby causing inconvenience in storage.

SUMMARY OF THE INVENTION

The primary objective of the present invention is to provide a combination hat rack structure including a domed housing, a support seat, and a frame, wherein the combination hat rack structure may provide a plane display effect, may be suspended on the wall, and may be disposed in an inclined manner, thereby enhancing the versatility of the combination hat rack structure Another objective of the present invention is to provide a combination hat rack structure, wherein the domed housing may be used individually.

A further objective of the present invention is to provide a combination hat rack structure, wherein the domed housing may be mounted on the support bar of the support seat, whereby the height of the domed housing may be increased, thereby enhancing the spatial variation of the domed housing, and increasing the display effect of the domed housing.

A further objective of the present invention is to provide a combination hat rack structure, wherein the support bar may be disposed in an inclined manner, so that the domed housing may also be disposed in an inclined manner, thereby enhancing the outer appearance of the domed housing.

A further objective of the present invention is to provide a combination hat rack structure, wherein the frame may be mounted on the domed housing, so that the non-domed hat may be mounted on the frame. Thus, the edges of the non-domed hat may be stretched by the edges of the frame, thereby enhancing the outer appearance of the non-domed hat.

A further objective of the present invention is to provide a combination hat rack structure, wherein the domed housing is formed with multiple through holes for providing a ventilating effect.

A further objective of the present invention is to provide a combination hat rack structure which has a small volume, so that the space occupied by the combination hat rack structure may be greatly reduced, thereby facilitating storage of the combination hat rack structure.

In accordance with the present invention, there is provided a combination hat rack structure, comprising a domed housing for mounting a hat, the domed housing formed with multiple through holes for providing a ventilating effect, and the domed housing having a periphery formed with a hanging hole for hanging the domed housing on a wall.

Further benefits and advantages of the present invention will become apparent after a careful reading of the detailed description with appropriate reference to the accompanying drawings.

DETAILED DESCRIPTION OF THE INVENTION

Figure 1:
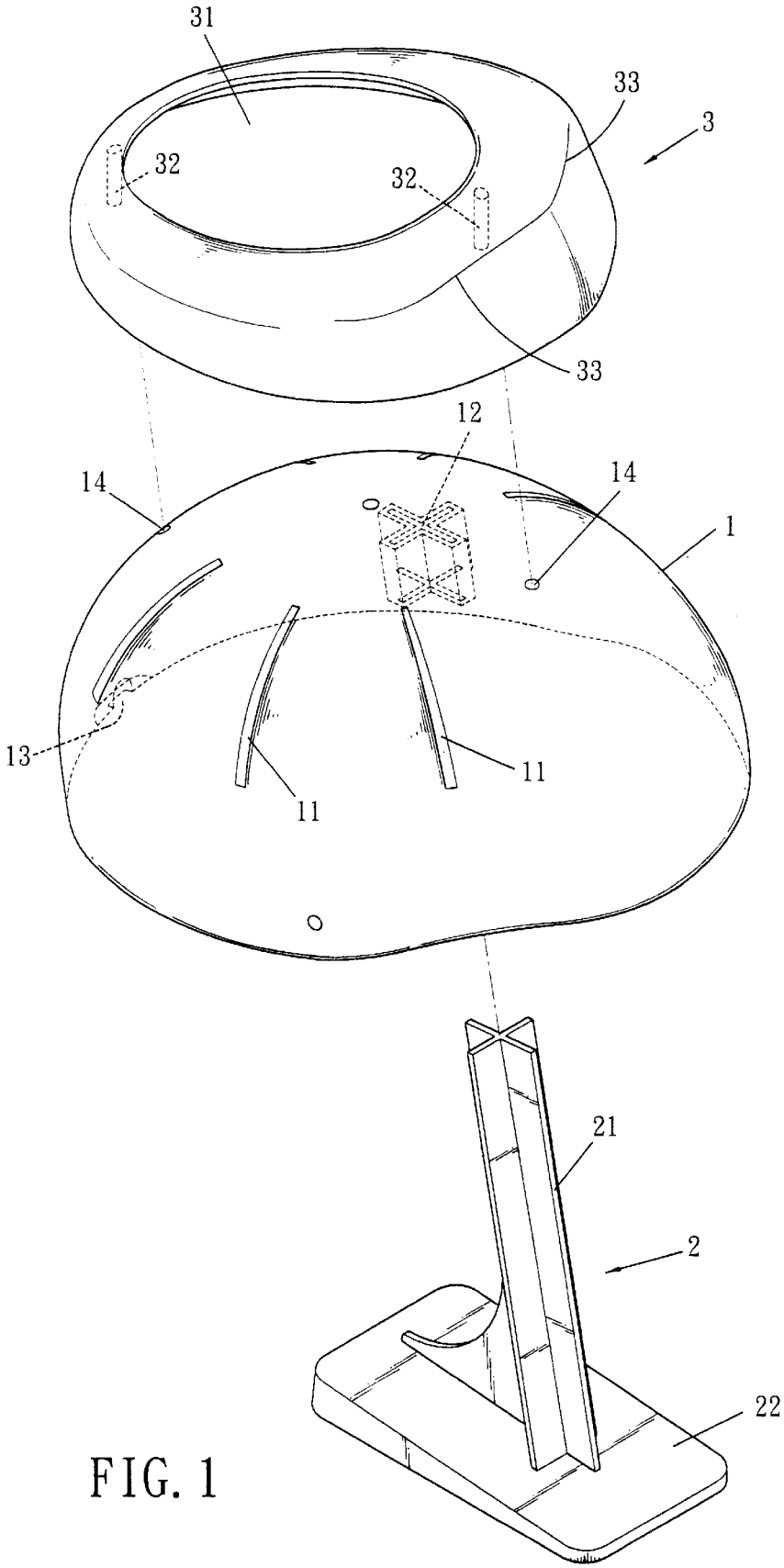
FIG. 1 is an exploded perspective view of a combination hat rack structure in accordance with a preferred embodiment of the present invention.
Figure 2:
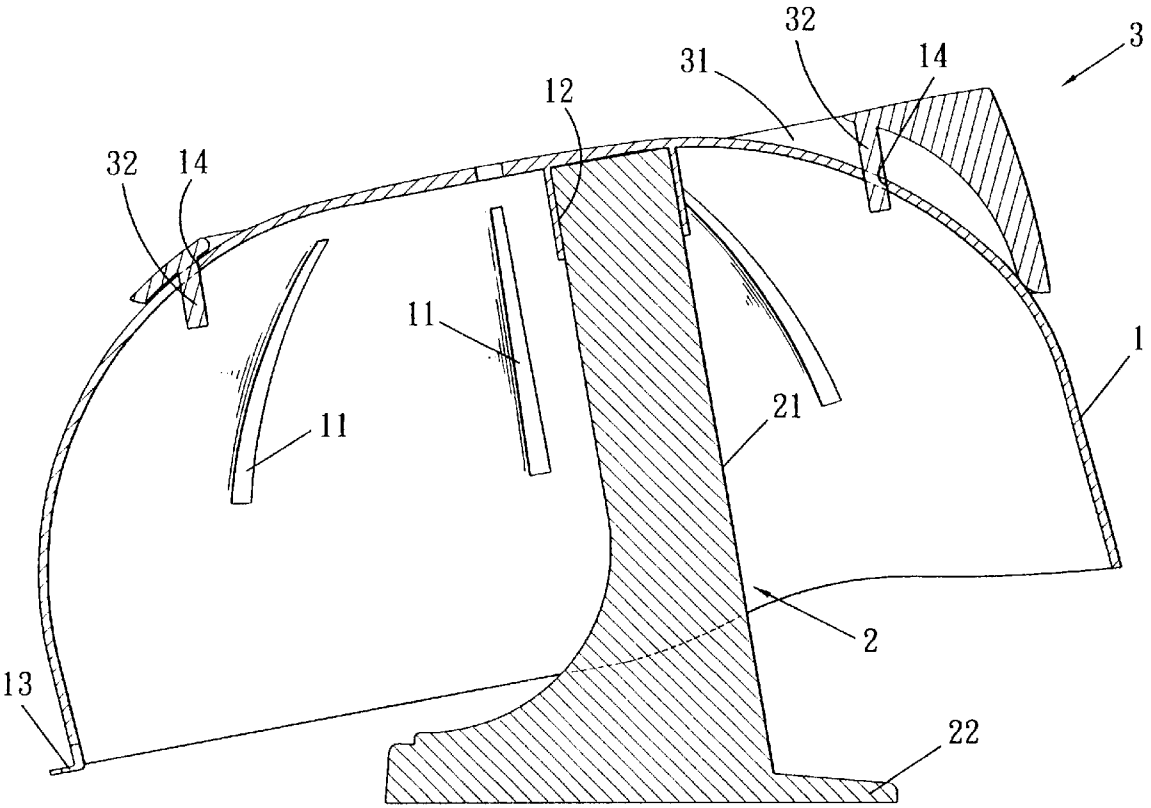
FIG. 2 is a side plan cross-sectional assembly view of the combination hat rack structure as shown in FIG. 1.
Figure 3:
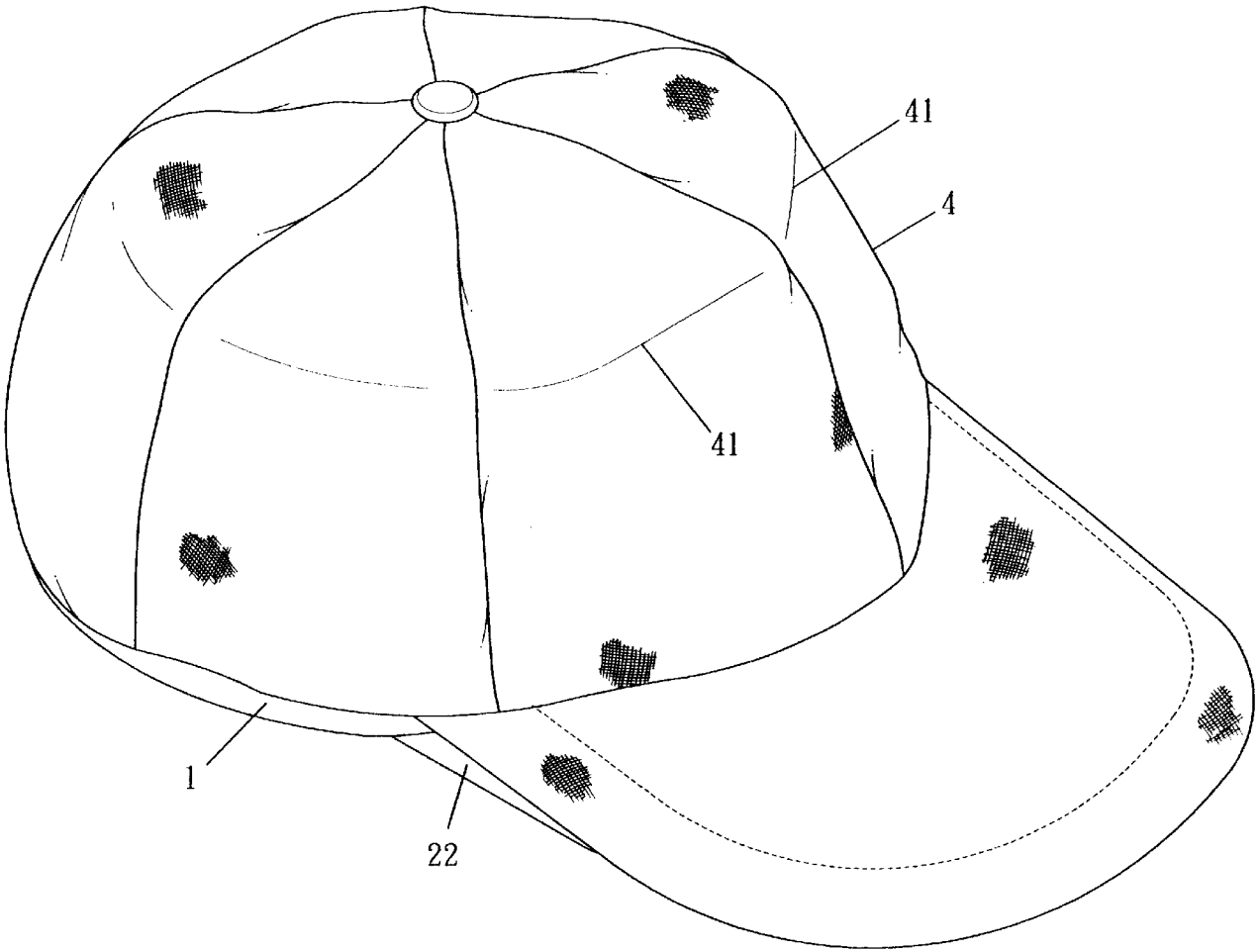
FIG. 3 is a schematic perspective view of the combination hat rack structure, wherein a hat is mounted on the domed housing.

Referring to the drawings and initially to FIGS. 1–3, a combination hat rack structure in accordance with a preferred embodiment of the present invention comprises a domed housing 1, a support seat 2, and a frame 3.

The domed housing 1 has a hat-shaped configuration for mounting a hat, and is formed with multiple through holes 11, for providing a ventilating effect. The domed housing 1 has an inner portion formed with a positioning recess 12. In the preferred embodiment, the positioning recess 12 has a cruciform shape. The domed housing 1 has a periphery formed with a hanging hole 13, for hanging the domed housing 1 on the wall.

The support seat 2 includes a support bar 21 integrally formed with a base 22. In the preferred embodiment, the support bar 21 has a cruciform shape. In assembly, the support bar 21 is inserted into the positioning recess 12 of the domed housing 1, so that the support bar 21 may be combined with the domed housing 1 integrally. In use, the support bar 21 may be used to support the domed housing 1 in an upright manner. Preferably, the support bar 21 may be disposed in an inclined manner, so that the domed housing 1 may also be disposed in an inclined manner, thereby enhancing the outer appearance of the domed housing 1.

The frame 3 has a center formed with an opening 31, so that the frame 3 may be mounted on the domed housing 1. The domed housing 1 is formed with multiple apertures 14. The frame 3 is provided with multiple positioning pins 32 matingly inserted into a respective one of the multiple apertures 14 of the domed housing, so that the frame 3 may be combined with the domed housing 1 integrally.

In addition, the frame 3 has a top having a periphery formed with multiple edges 33, so that when a non-domed hat 4 as shown in FIG. 3 is mounted under the frame 3, the edges 41 of the non-domed hat 4 may be supported by the edges 33 of the frame 3, thereby enhancing the outer appearance of the non-domed hat 4.

When in use, the domed housing 1 may be used individually. For example, the domed housing 1 may be placed on a table, thereby providing a plane display effect, and may be suspended on the wall by the hanging hole 13, thereby providing a spatial display effect.

Figure 4:
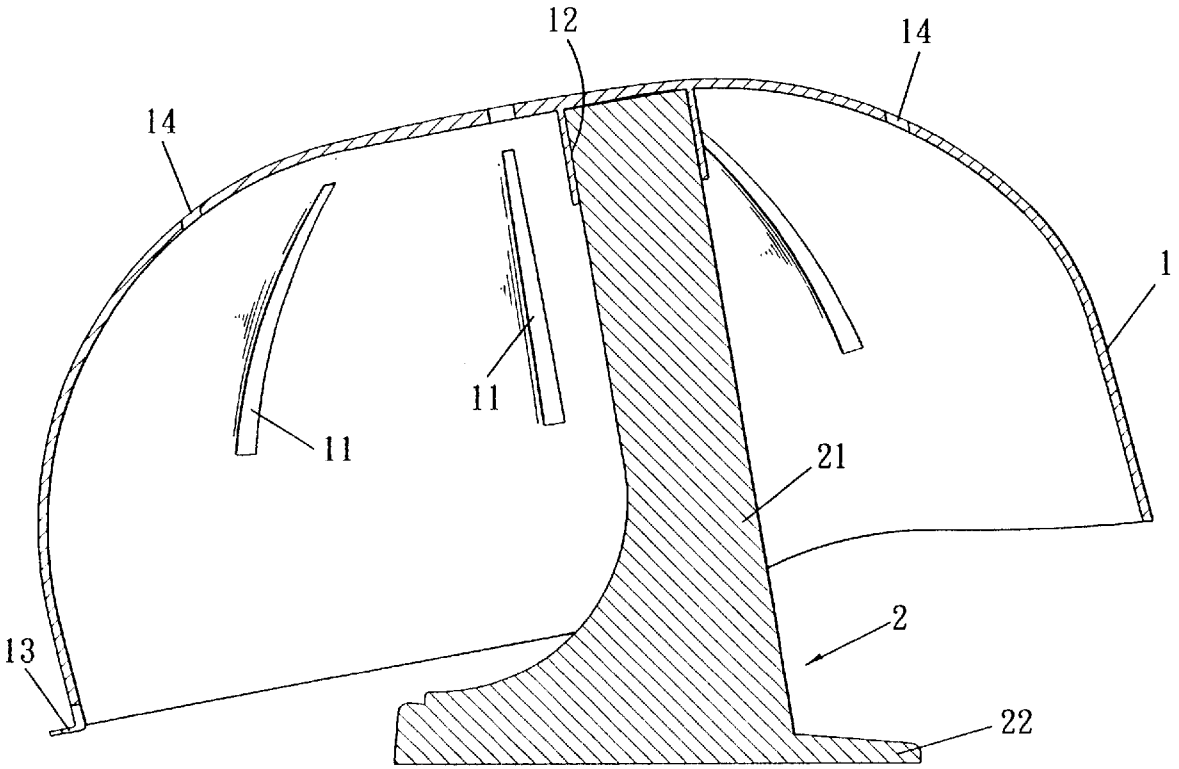
FIG. 4 is a side plan cross-sectional assembly view of the combination hat rack structure as shown in FIG. 1, in accordance with another embodiment of the present invention.

In addition, the domed housing 1 may be mounted on the support bar 21 of the support seat 2, whereby the height of the domed housing 1 may be increased, thereby enhancing the spatial variation of the domed housing 1, and increasing the display effect of the domed housing 1. Further, the support bar 21 may be disposed in an inclined manner as shown in FIG. 4, so that the domed housing 1 may also be disposed in an inclined manner, thereby enhancing the outer appearance of the domed housing 1.

Further, the frame 3 may be mounted on the domed housing 1, so that the non-domed hat 4 as shown in FIG. 3 may be mounted under the frame 3. Thus, the edges 41 of the non-domed hat 4 may be supported by the edges 33 of the frame 3, thereby enhancing the outer appearance of the non-domed hat 4.

Further, the domed housing 1 is formed with multiple through holes 11 for providing a ventilating effect.

Further, the combination hat rack structure in accordance with the present invention has a small volume, so that the space occupied by the combination hat rack structure may be greatly reduced, thereby facilitating storage of the combination hat rack structure.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A combination hat rack structure, comprising:

a domed housing for mounting a hat, the domed housing formed with multiple through holes for providing a ventilating effect, multiple apertures and having a periphery formed with a hanging hole for hanging the domed housing on a wall, a positioning recess formed in an inner portion of the domed housing;

a support seat including a support bar integrally formed with a base, the support bar inserted into the positioning recess of the domed housing whereby the support bar is used to support the domed housing in an upright manner, and a frame mounted on the domed housing and having a center formed with an opening whereby the frame is mounted on the domed housing, the frame having multiple positioning pins matingly inserted into a respective one of the multiple apertures of the domed housing, the frame having a top with a periphery formed with multiple edges, so that when a non-domed hat is mounted under the frame, edges of the non-domed hat are adapted to be supported by the edges of the frame thereby enhancing an outer appearance of the non-domed hat.

2. The combination hat rack structure in accordance with claim 1, wherein the support bar is disposed in an inclined manner so that the domed housing is disposed in an inclined manner thereby enhancing an outer appearance of the domed housing.

* * * * *